US009966709B2

(12) United States Patent
Cho et al.

(10) Patent No.: US 9,966,709 B2
(45) Date of Patent: May 8, 2018

(54) CONNECTOR AND COMMUNICATION COMPONENT INCLUDING THE SAME

(71) Applicant: INNERTRON, INC., Incheon (KR)

(72) Inventors: Hak Rae Cho, Bucheon-si (KR); Kwang Myoung Heo, Bucheon-si (KR); Jeoung Il Shin, Incheon (KR); Jun Yong Kim, Incheon (KR)

(73) Assignee: INNERTRON, INC., Incheon (KR)

( * ) Notice: Subject to any disclaimer, the term of this patent is extended or adjusted under 35 U.S.C. 154(b) by 0 days. days.

(21) Appl. No.: 15/278,680

(22) Filed: Sep. 28, 2016

(65) Prior Publication Data

US 2018/0083400 A1 Mar. 22, 2018

(30) Foreign Application Priority Data

Sep. 19, 2016 (KR) ..... 10-2016-0119488

(51) Int. Cl.
*H01R 24/52* (2011.01)
*H01R 103/00* (2006.01)

(52) U.S. Cl.
CPC ..... *H01R 24/52* (2013.01); *H01R 2103/00* (2013.01)

(58) Field of Classification Search
CPC ..... H01R 24/38; H01R 24/50
USPC ..... 439/675, 63, 581
See application file for complete search history.

(56) References Cited

U.S. PATENT DOCUMENTS 3,673,546 A * 6/1972 Green ..... H01R 24/542 439/172
4,593,464 A * 6/1986 Williams ..... H01R 4/10 228/136
5,001,443 A * 3/1991 Martin, III ..... H01P 5/10 333/125

(Continued)

FOREIGN PATENT DOCUMENTS

JP 2000-048912 A 2/2000
JP 2008-041600 A 2/2008

(Continued)

OTHER PUBLICATIONS

Notice to Submit Response issued in the Japanese Patent Office in Japanese Application No. 2016-188587 dated Aug. 8, 2017, along with an English translation thereof.

(Continued)

*Primary Examiner* — Tulsidas C Patel
*Assistant Examiner* — Marcus Harcum
(74) *Attorney, Agent, or Firm* — Sughrue Mion, PLLC

(57) ABSTRACT

A connector, which is coupled to a first communication component, including: a connector body; a fitting portion, which is formed on one end of the connector body, configured to fix the connector body by being adhered to a wall of the first communication component; and a ground stabilization member coupled to the connector body and the first communication component, wherein the ground stabilization member includes: a fixing portion configured to fix the ground stabilization member to an inner wall of the connector body; an insertion portion inserted in an insertion hole of the first communication component, wherein a plurality of slots imparting elasticity are formed; and a (Continued)

ground contact portion configured to perform a grounding function by contacting an inner wall of the insertion hole due to the elasticity.

10 Claims, 5 Drawing Sheets

(56) References Cited

U.S. PATENT DOCUMENTS 5,563,562 A * 10/1996 Szwec ..... H01R 24/44 174/152 GM
6,079,986 A * 6/2000 Beshears ..... H01R 9/096 439/581
6,174,206 B1 * 1/2001 Yentile ..... H01R 24/542 439/578
6,386,888 B1 * 5/2002 Skopic ..... H01R 24/50 439/581
7,070,448 B2 * 7/2006 Khemakhem ..... H01R 24/542 439/322
7,197,821 B2 * 4/2007 Khemakhem ..... H01R 9/032 29/857
7,262,672 B2 * 8/2007 Lee ..... H01R 24/44 333/260
8,876,549 B2 * 11/2014 Van Swearingen .. H01R 13/629 439/578
9,641,148 B2 * 5/2017 Seo ..... H03H 7/0161
2011/0312215 A1 * 12/2011 Uesaka ..... G01R 1/06772 439/581
2015/0042419 A1 * 2/2015 Cho ..... H01P 1/2082 333/204
2015/0222061 A1 * 8/2015 Kaneko ..... H01R 24/50 439/581
2016/0134005 A1 * 5/2016 Cho ..... H01P 7/04 333/134

FOREIGN PATENT DOCUMENTS

JP 2008-270213 A 11/2008
KR 10-2010-0048810 5/2010
KR 10-2010-0104679 9/2010
KR 10-1162659 7/2012

OTHER PUBLICATIONS

Notice to Submit Response issued in Korean Application No. KR10-2016-0119488 dated Sep. 25, 2017.

* cited by examiner

CONNECTOR AND COMMUNICATION COMPONENT INCLUDING THE SAME

CROSS REFERENCE TO RELATED APPLICATIONS

This application claims priority from Korean Patent Application No. 10-2016-0119488, filed on Sep. 19, 2016, in the Korean Intellectual Property Office, the contents of which are incorporated herein by reference in their entireties.

BACKGROUND

1. Field

The inventive concept relates to a connector and a communication component including the same, and more particularly, a connector including a ground stabilization member coupled to a connector body and a communication component, and the communication component including the same.

2. Description of the Related Art

A communication system uses various filters. The filters, through which only signals in a specific frequency band pass, may be divided into a low pass filter (LPF), a band pass filter (BPF), a high pass filter (HPF), and a band stop filter (BSF) according to a frequency band to be filtered.

Furthermore, the filters may be divided into an inductive-capacitive (LC) filter, a transmission line filter, a cavity filter, a dielectric resonator (DR) filter, a ceramic filter, a coaxial filter, a waveguide filter, and a surface acoustic wave (SAW) filter according to a method of manufacturing a filter and a device for the filter.

A filter may include a connector for receiving a signal from an external communication component or for outputting a filtered signal to another communication component, wherein the connector may affect performance of the filter.

SUMMARY

One or more embodiments include a connector including a ground stabilization member coupled to a connector body and a communication component, and the communication component including the same.

According to an aspect of the inventive concept, A connector coupled to a first communication component, the connector comprising: a connector body; a fitting portion, which is formed on one end of the connector body, configured to fix the connector body by being adhered to a wall of the first communication component; and a ground stabilization member coupled to the connector body and the first communication component, wherein the ground stabilization member comprises: a fixing portion configured to fix the ground stabilization member to an inner wall of the connector body; an insertion portion inserted in an insertion hole of the first communication component, wherein a plurality of slots imparting elasticity are formed; and a ground contact portion configured to perform a grounding function by contacting an inner wall of the insertion hole due to the elasticity.

In an embodiment, wherein a diameter of the ground contact portion is greater than a diameter of the insertion portion.

In an embodiment, wherein the insertion hole is formed in any one wall of a housing of the first communication component formed of metal, and the ground contact portion performs the grounding function by contacting the inner wall of the insertion hole.

In an embodiment, the connector further comprising: a groove formed between the insertion portion and the ground contact portion.

In an embodiment, wherein a diameter of the insertion portion becomes gradually larger from the fixing portion toward the ground contact portion.

In an embodiment, wherein a width of each of the plurality of slots becomes gradually larger from the fixing portion toward the ground contact portion.

In an embodiment, wherein at least one fastening hole is formed in the fitting portion, and the connector is adhered and fastened to the first communication component by a fastening member which penetrates through the fastening hole and is inserted in the first communication component.

In an embodiment, wherein a second communication component is coupled to the other end of the connector body, wherein the connector body comprises: a first projecting portion for receiving a communication signal from the second communication component; and a second projecting portion connected to a ground of the second communication component.

In an embodiment, wherein each of the first and second projecting portions comprises a plurality of slots imparting elasticity to each of the first and second projecting portions.

According to an aspect of the inventive concept, a communication component comprising: a metal housing configured to store a plurality of resonators in an internal cavity; and a connector coupled to the metal housing, wherein the connector comprises: a connector body; a fitting portion, which is formed on one end of the connector body, configured to fix the connector body by being adhered to a wall of the metal housing; and a ground stabilization member coupled to the connector body and the metal housing, wherein the ground stabilization member comprises: a fixing portion configured to fix the ground stabilization member to an inner wall of the connector body; an insertion portion inserted in an insertion hole of the metal housing, wherein a plurality of slots imparting elasticity are formed; and a ground contact portion configured to perform a grounding function by contacting an inner wall of the insertion hole due to the elasticity.

A connector according to the inventive concept may have improved communication characteristics of a communication component, for example, PIMD characteristics by including a ground stabilization member coupled to a connector body and a communication component.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
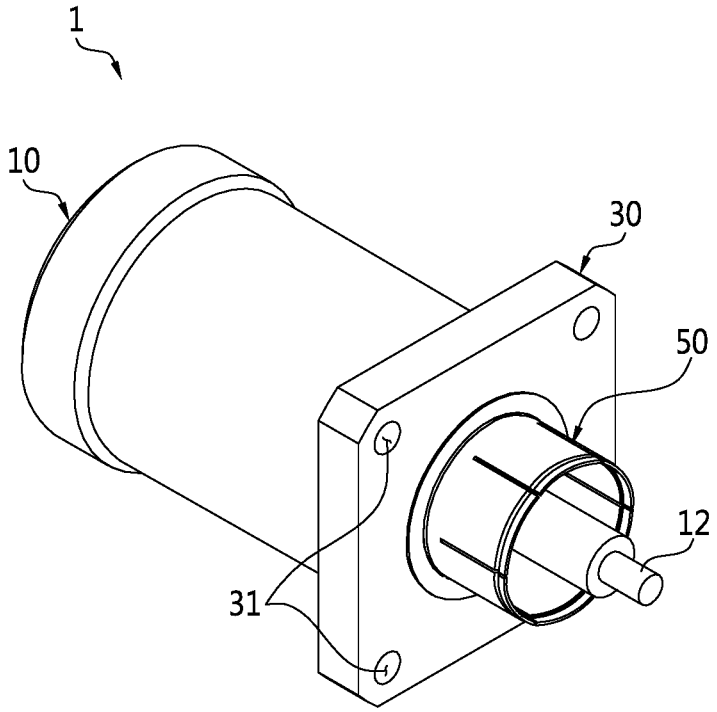
FIG. 1 is a perspective view of a connector according to an embodiment of the inventive concept.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. Expressions such as "at least one of", when preceding a list of elements, modify the entire list of elements and do not modify the individual elements of the list.

In the description of the present disclosure, certain detailed explanations of the related art are omitted when it is deemed that they may unnecessarily obscure the essence of the inventive concept. While the terms including an ordinal number, such as "first", "second", etc., may be used to describe various components, such components are not be limited by theses terms. The terms first and second should not be used to attach any order of importance but are used to distinguish one element from another element.

Throughout the specification, it will be understood that when a unit is referred to as being "connected" to another element, it may be "directly connected" to the other element or "electrically connected" to the other element in a state in which intervening elements are present.

Furthermore, components of the specification are divided in accordance with a main function of each component. For example, combining two or more elements are in a single component, as needed, or may be one component configuration is subdivided into two or more components. Each of the components may further perform some or all of the functions of other components as well as its main functions, and some of the main functions may also be performed by other components.

Hereinafter, embodiments of the present invention will be described in detail with reference to the accompanying drawings.

Figure 2:
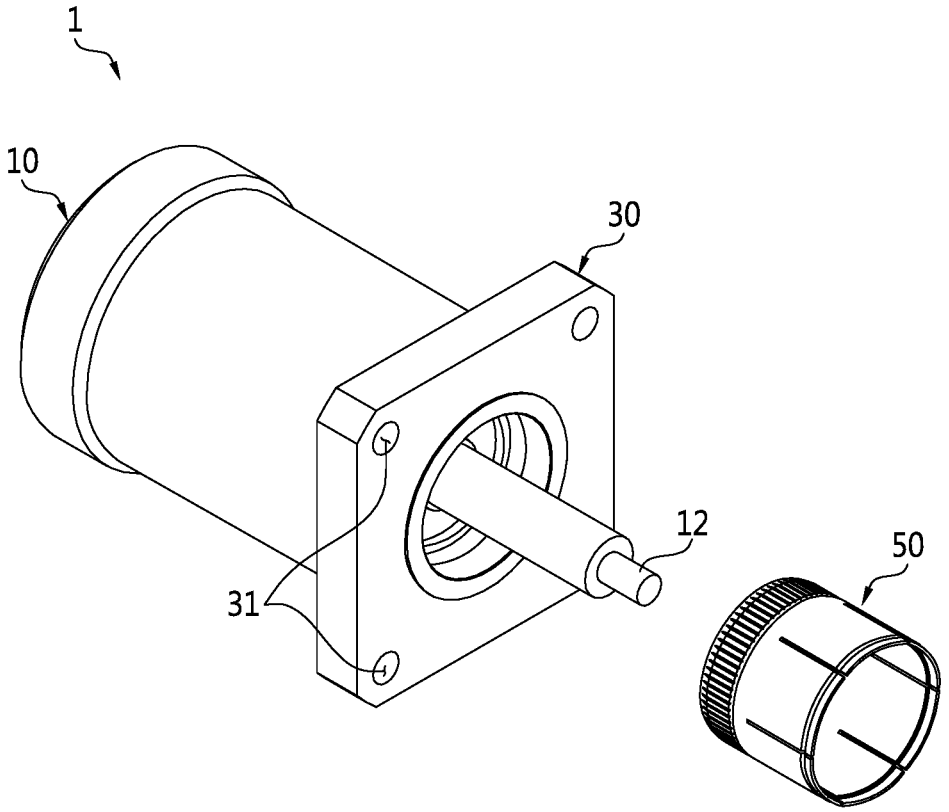
FIG. 2 is a disassembled perspective view of the connector of FIG. 1, in which a ground stabilization member is separated from the connector.

FIG. 1 is a perspective view of a connector according to an embodiment of the inventive concept. FIG. 2 is a disassembled perspective view of the connector of FIG. 1, in which a ground stabilization member is separated from the connector.

Referring to FIGS. 1 and 2, a connector 1 may include a connector body 10, a fitting portion 30, and a ground stabilization member 50.

A first signal transmission member 12, which transmits a signal input to the connector 1 to a communication component connected to the fitting portion 30 of the connector 1 or a signal output from the communication component connected to the fitting portion 30 of the connector 1 to the outside of the communication component, may be included in the connector body 10.

The fitting portion 30, which is formed on one end of the connector body 10, may fix the connector body 10 by being adhered to a wall of the communication component connected to the connector 1.

At least one fastening hole 31 may be formed in the fitting portion 30, in which a fastening member may be coupled to the fastening hole 31.

According to an embodiment, the fitting portion 30 may be formed as a part of the connector body 10.

The ground stabilization member 50 may be coupled to the connector 1 and the communication component connected to the connector 1.

A detailed structure and a coupling structure of the connector 1 will be described in detail referring to FIGS. 3 to 5.

Figure 3:
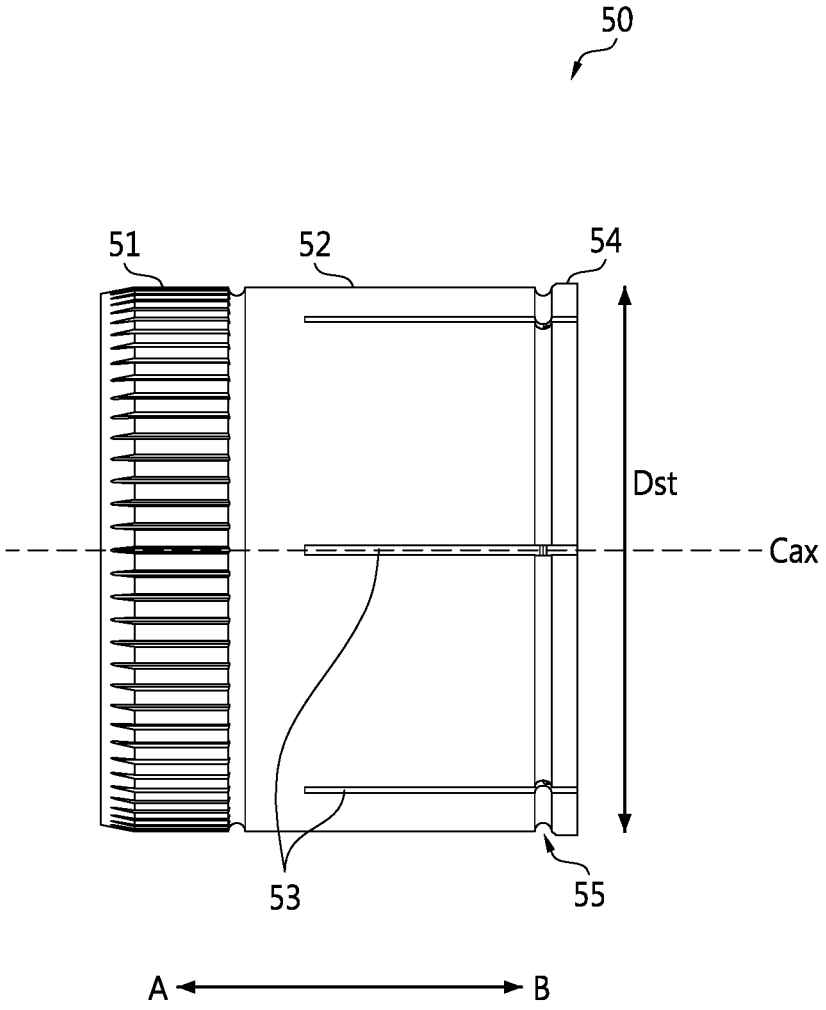
FIG. 3 is a side view of a ground stabilization member of FIG. 1.

FIG. 3 is a side view of the ground stabilization member 50 of FIG. 1.

Referring to FIGS. 1 to 3, the ground stabilization member 50 may include a fixing portion 51, an insertion portion 52, a plurality of first slots 53, a ground contact portion 54, and a groove 55.

The fixing portion 51 may fix the ground stabilization member 50 to an inner wall of the connector body 10.

According to an embodiment, the fixing portion 51 may include a projection to be adhered to the inner wall of the connector body 10. For example, the fixing portion 51 may include a knurling pattern.

According to an embodiment, the fixing portion 51 may be coupled and fixed to the inner wall of the connector body 10 using a method of interference-fitting.

The insertion portion 52 may be inserted in the communication component connected to the fitting portion 30 of the connector 1. A coupling structure of the insertion portion 52 inserted in the communication component will be described in detail referring to FIGS. 4 and 5.

The insertion portion 52 may include the plurality of first slots 53 imparting elasticity to the insertion portion 52. According to an embodiment, the shape and the number of the plurality of first slots 53 formed in the insertion portion 52 may vary according to a required elastic strength.

According to an embodiment, a width of each of the plurality of first slots 53 formed in the insertion portion 52 may become gradually larger from the fixing portion 51 toward the ground contact portion 54. For example, a width of each of the plurality of first slots 53 may become smaller toward a direction A, and may become larger toward a direction B.

According to an embodiment, a diameter of the insertion portion 52 may become gradually larger from the fixing portion 51 toward the ground contact portion 54. In other words, the diameter of the insertion portion 52 may become smaller toward the direction A, and may become larger toward the direction B.

The ground contact portion 54 may perform a grounding function by contacting a ground of the communication component connected to the connector 1.

FIG. 3 illustratively shows that a termination of the connector 1 includes the ground contact portion 54 separately from the insertion portion 52, but the ground contact portion 54 may be a part or the whole of the insertion portion 52.

According to an embodiment, a diameter Dst of the ground contact portion 54 may be greater than a diameter of the insertion portion 52.

A groove 55 may be formed between the insertion portion 52 and the ground contact portion 54. The ground contact portion 54 may have a greater elastic strength in an outer direction from a central axis Cax of the ground stabilization member 50 due to the groove 55. In this case, the ground contact portion 54 may more stably contact the ground of the communication component.

According to an embodiment, the ground contact portion 54 may be at least two, and thus, the number of portions contacting the ground of the communication component may be at least two.

According to an embodiment, a contact portion of the ground contact portion 54 may have a curved surface.

Figure 4:
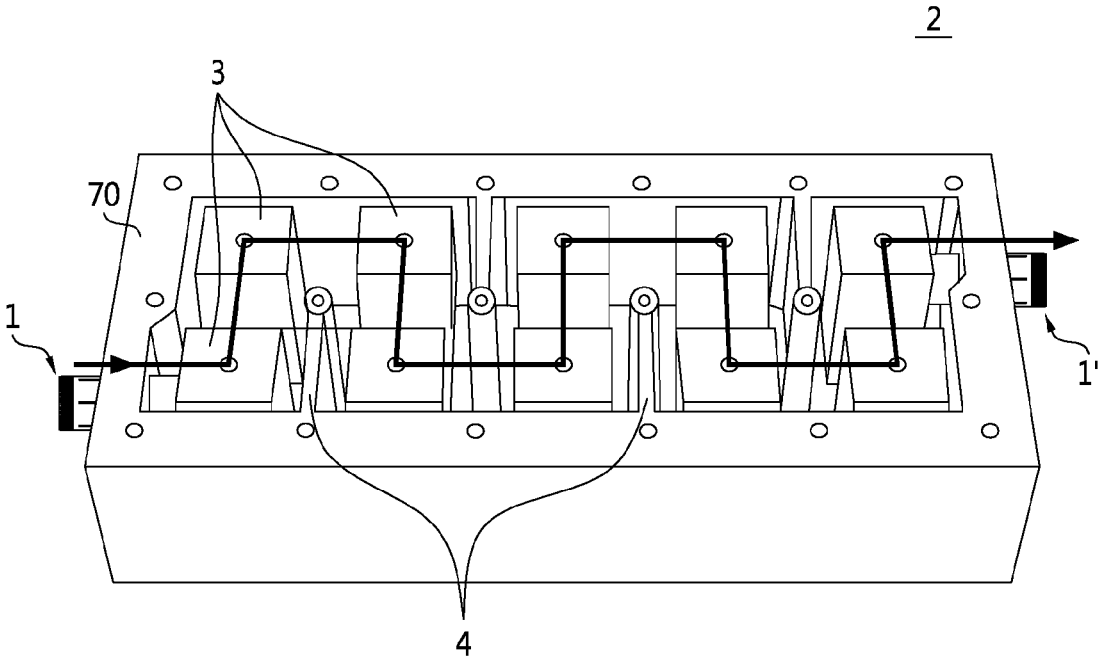
FIG. 4 is a perspective view of the connector of FIG. 1, in which the connector is coupled to a wall of a cavity-type communication component.

FIG. 4 is a perspective view of the connector 1 of FIG. 1, in which the connector 1 is coupled to a wall of a cavity-type communication component.

Referring to FIGS. 1 to 4, a first communication component 2 may be embodied in different forms such as a filter, a duplexer, or a multiplexer.

The first communication component 2 may include a cavity divided by a plurality of barrier ribs 4 in a housing 70.

The cavity may include a plurality of resonators 3, and a signal input to the connector 1 on one side of the first communication component 2, for example, an input connector, may be transmitted to a connector 1' on the other side of the first communication component 2, for example, an output connector along the plurality of resonators 3.

According to an embodiment, each of the plurality of resonators 3 may be formed of a dielectric or a metal.

According to an embodiment, the housing 70 may include a metal, or may have an outer surface plated with a conductive material (for example, silver (Ag) or copper (Cu)).

The connector 1 or 1' may be coupled to a wall of the housing 70. A structure of the connector 1' on an output terminal may be substantially same as that of the connector 1 on an input terminal, and a structure of the connector 1 or 1' coupled to the wall of the housing 70 will be described in detail referring to FIG. 5.

Figure 5:
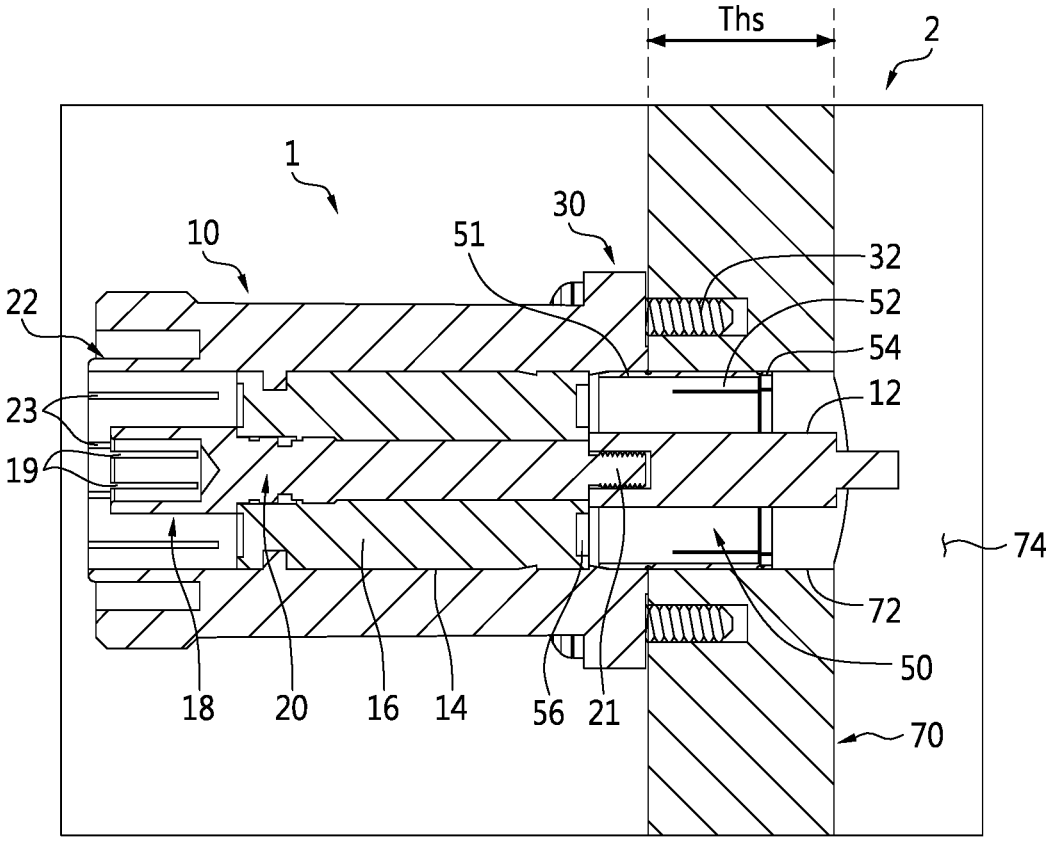
FIG. 5 is a cross-sectional view of the connector and the communication component, which are coupled to each other, of FIG. 4.

FIG. 5 is a cross-sectional view of the connector and the communication component, which are coupled to each other, of FIG. 4.

Referring to FIGS. 1 to 5, the fitting portion 30 is formed on one end of the connector body 10. A fastening member 32 may be inserted in the wall of the housing 70 of the first communication component 2 after penetrating through the fastening hole 31 of the fitting portion 30, and may adhere and fasten the connector 1 to the wall of the housing 70.

The ground stabilization member 50 may be coupled to the connector body 10 and the housing 70 of the first communication component 2.

The fixing portion 51 of the ground stabilization member 50 may be adhered to the inner wall 14 of the connector body 10, and thus, may fix the ground stabilization member 50.

A stopper 56 may support the fixing portion 51 of the ground stabilization member 50 in order the fixing portion 51 not to be inserted in the connector body 10 anymore. In other words, a depth of the ground stabilization member 50 inserted in the connector body 10 may be controlled by the stopper 56.

The insertion portion 52 of the ground stabilization member 50 may be inserted in an insertion hole 72 of the housing 70 of the first communication component 2, and thus, may be coupled to the first communication component 2. According to an embodiment, a length of the insertion portion 52 of the ground stabilization member 50 may be shorter than a thickness Ths of the wall of the housing 70.

The ground contact portion 54 of the ground stabilization member 50 may perform a grounding function by contacting an inner wall of the insertion hole 72 of the housing 70 of the first communication component 2.

Here, the ground contact portion 54 of the ground stabilization member 50 may stably contact the inner wall of the insertion hole 72 of the housing 70 by elasticity imparted from the plurality of first slots 53 formed in the insertion portion 52.

According to an embodiment, even if an error occurs with respect to a position of the ground contact portion 54 when the ground stabilization member 50 is inserted in and coupled to the insertion hole 72, the ground contact portion 54 may stably contact any point on the inner wall of the insertion hole 72. Accordingly, the ground contact portion 54 may perform a stable grounding function. Furthermore, the connector 1 may have improved passive intermodulation distortion (PIMD) characteristics due to the stable grounding function of the ground contact portion 54.

A second communication component (not shown) may be coupled to the other side of the connector body 10 (for example, the opposite side of the first communication component 2). The other side of the connector body 10 may include a first projecting portion 18 for receiving a communication signal from the second communication component, and a second projecting portion 22 connected to a ground of the second communication component.

According to an embodiment, the first projecting portion 18 may include a plurality of second slots 19 imparting elasticity to the first projecting portion 18. According to an embodiment, the number of the plurality of second slots 19 formed in the first projecting portion 18 may vary according to a required elastic strength.

According to an embodiment, the second projecting portion 22 may include a plurality of third slots 23 imparting elasticity to the second projecting portion 22. According to an embodiment, the number of the plurality of third slots 23 formed in the second projecting portion 22 may vary according to a required elastic strength.

A signal input from the second communication component coupled to the first projecting portion 18 may be transmitted to the first communication component 2 through the second signal transmission member 20 and the first signal transmission member 12.

The second signal transmission member 20 may be connected to the first signal transmission member 12 by the connecting portion 21. Furthermore, the second signal transmission member 20 may be coupled and fixed to the connector body 10 through a coupling member 16.

According to an embodiment, the first signal transmission member 12 may be directly electrically connected or coupled to at least one of the plurality of resonators 3 formed inside 74 the housing.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A connector coupled to a first communication component, the connector comprising:

a connector body;

a fitting portion, which is formed on one end of the connector body, configured to fix the connector body by being adhered to a wall of the first communication component; and a ground stabilization member coupled to the connector body and the first communication component, wherein the ground stabilization member comprises:

a fixing portion configured to fix the ground stabilization member to an inner wall of the connector body; and an insertion portion designed to be inserted in an insertion hole formed in a wall of the first communication component, wherein a plurality of slots imparting elasticity are formed and a length of the insertion portion is shorter than a thickness of the wall of the first communication component, wherein the insertion portion comprises a ground contact portion formed at an end of the insertion portion and configured to perform a grounding function by contacting an inner wall of the insertion hole due to the elasticity such that contact between the ground stabilization member and the inner wall of the insertion hole is made at an end of the ground stabilization member.

2. The connector of claim 1, wherein a diameter of the ground contact portion is greater than a diameter of the insertion portion.

3. The connector of claim 1, wherein the insertion hole is formed in any one wall of a housing of the first communication component formed of metal, and the ground contact portion performs the grounding function by contacting the inner wall of the insertion hole.

4. The connector of claim 1, further comprising:

a groove formed between the insertion portion and the ground contact portion.

5. The connector of claim 1, wherein a diameter of the insertion portion becomes gradually larger from the fixing portion toward the ground contact portion.

6. The connector of claim 1, wherein a width of each of the plurality of slots becomes gradually larger from the fixing portion toward the ground contact portion.

7. The connector of claim 1, wherein at least one fastening hole is formed in the fitting portion, and the connector is adhered and fastened to the first communication component by a fastening member which penetrates through the fastening hole and is inserted in the first communication component.

8. The connector of claim 1, wherein the connector body is configured to be coupled to a second communication component through another end of the connect body, and wherein the connector body comprises:

a first projecting portion for receiving a communication signal from the second communication component; and a second projecting portion connected to a ground of the second communication component.

9. The connector of claim 8, wherein each of the first and second projecting portions comprises a plurality of slots imparting elasticity to each of the first and second projecting portions.

10. A communication component comprising:

a metal housing configured to store a plurality of resonators in an internal cavity; and a connector coupled to the metal housing, wherein the connector comprises:

a connector body;

a fitting portion, which is formed on one end of the connector body, configured to fix the connector body by being adhered to a wall of the metal housing; and a ground stabilization member coupled to the connector body and the metal housing, wherein the ground stabilization member comprises:

a fixing portion configured to fix the ground stabilization member to an inner wall of the connector body; and an insertion portion designed to be inserted in an insertion hole formed in a wall of the first communication component, wherein a plurality of slots imparting elasticity are formed and a length of the insertion portion is shorter than a thickness of the wall of the first communication component, and wherein the insertion portion comprises a ground contact portion formed at an end of the insertion portion and configured to perform a grounding function by contacting an inner wall of the insertion hole due to the elasticity such that contact between the ground stabilization member and the inner wall of the insertion hole is made at an end of the ground stabilization member.

* * * * *